US005766023A

United States Patent [19]

Noschese et al.

[11] Patent Number: 5,766,023

[45] Date of Patent: Jun. 16, 1998

[54] ELECTRICAL CONNECTOR WITH HIGH SPEED AND HIGH DENSITY CONTACT STRIP

[75] Inventors: Rocco J. Noschese, Wilton, Conn.; Heinz Piorunneck, Lake Worth, Fla.

[73] Assignee: Framatome Connectors USA Inc., Fairfield, Conn.

[21] Appl. No.: 511,544

[22] Filed: Aug. 4, 1995

[51] Int. Cl.[6] ..... H01R 9/09

[52] U.S. Cl. ..... 439/74; 439/62

[58] Field of Search ..... 439/74, 62, 59, 439/632, 636, 637, 682, 886, 510, 513

[56] References Cited

U.S. PATENT DOCUMENTS

| | | | |
|---|---|---|---|
| 4,070,084 | 1/1978 | Hutchison | 339/143 R |
| 4,932,888 | 6/1990 | Senor | 439/108 |
| 5,026,292 | 6/1991 | Pickles et al. | 439/108 |
| 5,120,232 | 6/1992 | Korsunsky | 439/108 |
| 5,127,839 | 7/1992 | Korsunsky et al. | 439/79 |
| 5,135,405 | 8/1992 | Fusselman et al. | 439/108 |
| 5,141,453 | 8/1992 | Fusselman et al. | 439/608 |
| 5,156,554 | 10/1992 | Rudoy et al. | 439/108 |
| 5,161,987 | 11/1992 | Sinisi | 439/101 |
| 5,163,835 | 11/1992 | Morlion et al. | 439/67 |
| 5,507,651 | 4/1996 | Tanaka et al. | 439/632 |

*Primary Examiner*—P. Austin Bradley
*Assistant Examiner*—Yong Ki Kim
*Attorney, Agent, or Firm*—Perman & Green, LLP

[57] ABSTRACT

An electrical connector with a housing and a contact strip. The housing has a receiving area with openings into the receiving area on opposite sides of the housing. The contact strip has a support of resilient conductive material, an insulating layer on the support, and signal conductors on the insulating layer. The contact strip is located in the receiving area with portions of the signal conductors located at the openings at the opposite sides of the housing.

2 Claims, 5 Drawing Sheets

ELECTRICAL CONNECTOR WITH HIGH SPEED AND HIGH DENSITY CONTACT STRIP

BACKGROUND OF THE INVENTION

1. Field of the Invention

The present invention relates to an electrical connector and, more particularly, to a connector with a contact strip.

2. Prior Art

U.S. Pat. 5,163,835 discloses an electrical connector with a contact strip having a grounding conductor support. Other U.S. Patents in the electrical connector area include the following:

| | |
|---|---|
| U.S. Pat. No. 4,070,084 | U.S. Pat. No. 4,932,888 |
| U.S. Pat. No. 5,026,292 | U.S. Pat. No. 5,120,232 |
| U.S. Pat. No. 5,127,839 | U.S. Pat. No. 5,135,405 |
| U.S. Pat. No. 5,141,453 | U.S. Pat. No. 5,156,554 |
| U.S. Pat. No. 5,161,987 | U.S. Pat. No. 5,163,835 |

SUMMARY OF THE INVENTION

In accordance with one embodiment of the present invention an electrical connector is provided comprising a housing and a contact strip. The housing has a receiving area with a first opening into the receiving area on a first side of the housing and a second opening into the receiving area on an opposite second side of the housing. The contact strip has a support of resilient conductive material, an insulating layer on the support, and signal conductors on the insulating layer. The contact strip is located in the receiving area on the housing with portions of the signal conductors being located at the first and second openings.

In accordance with another embodiment of the present invention an electrical connector for connecting a first printed circuit board to a second printed circuit board is provided comprising a housing and a contact strip. The housing has a first housing member connected to a second housing member. The first housing member has contact pins extending therethrough and the second housing member has a receiving area with first ends of the contact pins therein. The contact strip has a support of resilient conductive material, an insulating layer on the support, and signal conductors on the insulating layer. The contact strip is located in the receiving area of the housing. The signal conductors contact the first ends of some of the contact pins and also extending through openings in one side of the housing for connection to one of the printed circuit boards.

In accordance with another embodiment of the present invention an electrical connector for connecting a first printed circuit board to a second printed circuit board is provided comprising a housing and a contact strip. The housing has a first housing member connected to a second housing member. The first housing member has contact pins extending therethrough. The second housing member has a receiving area with first ends of the contact pins therein. The contact strip has a support of resilient conductive material, an insulating layer on the support, and signal conductors on the insulating layer. The contact strip is located in the receiving area of the housing. First portions of the signal conductors contact the first ends of some of the contact pins. The housing has a printed circuit board edge receiving slot into the receiving area with second portions of the signal conductors extending into the slot.

In accordance with another embodiment of the present invention an electrical connector is provided comprising a housing and a contact strip. The housing has a receiving area. A first opening is provided in the housing into the receiving area on a first bottom side of the housing. A card edge receiving slot extends into the receiving area on a second side of the housing. The contact strip has a support of resilient conductive material, an insulating layer on the support, and signal conductors on the insulating layer. The contact strip is located in the receiving area of the housing. The signal conductors extend into the card edge receiving slot and from the first opening at the bottom side of the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
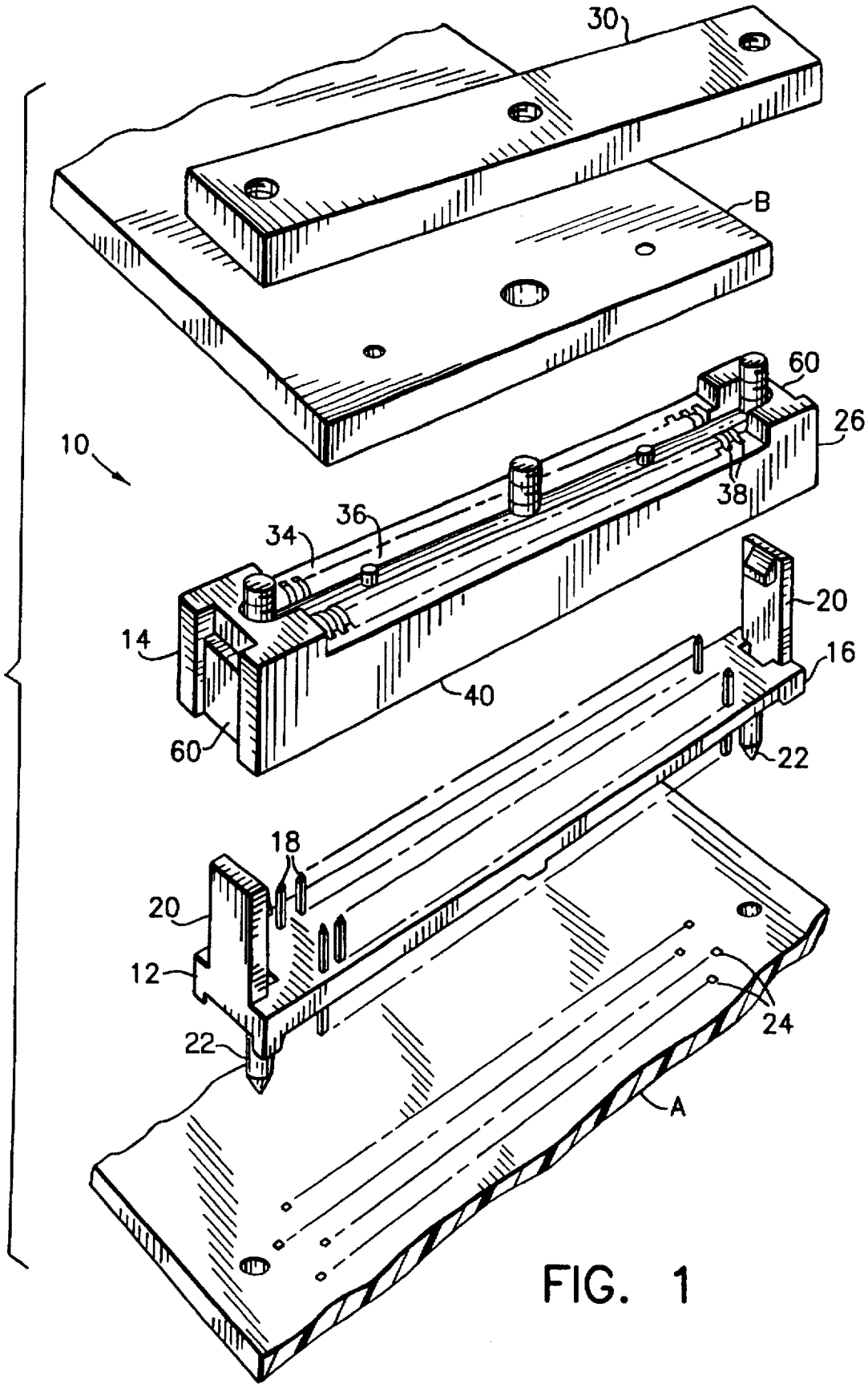
FIG. 1 is an exploded perspective view of portions of two printed circuit boards and an electrical connector incorporating features of the present invention.

Referring to FIG. 1, there is shown an exploded view of an electrical connector 10 incorporating features of the present invention and portions of two printed circuit boards A, B that are connected by the connector 10. Although the present invention will be described with reference to the embodiments shown in the drawings, it should be understood that the present invention can be embodied in various different forms of embodiments. Features of the present invention may be incorporated into different types of electrical connectors other than card edge connectors. In addition, any suitable size, shape, or type of elements or materials could be used.

The connector 10 generally comprises a first connector 12 and a second connector 14. The first connector 12 has a first housing 16 and first contacts 18. The first housing has two snap lock latches 20 at its ends and mounting posts 22 extending from its bottom. The first contacts 18 are comprised of pin contacts that extend through the first housing 16 and are adapted to be inserted into holes 24 in the printed circuit board A. In alternate embodiments, other types of first contacts and other types of latches or locking connectors could be provided.

Figure 2:
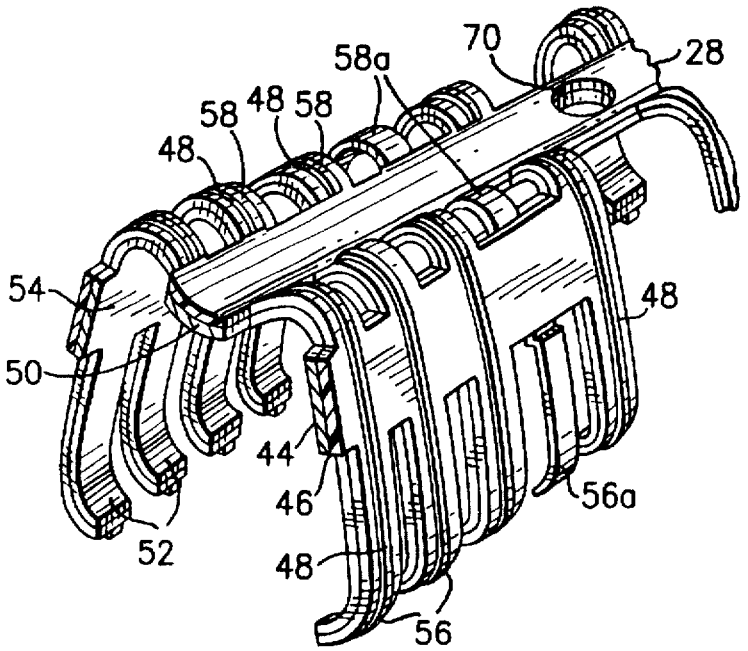
FIG. 2 is a partial perspective view of a contact strip used in the connector shown in FIG. 1.
Figure 3:
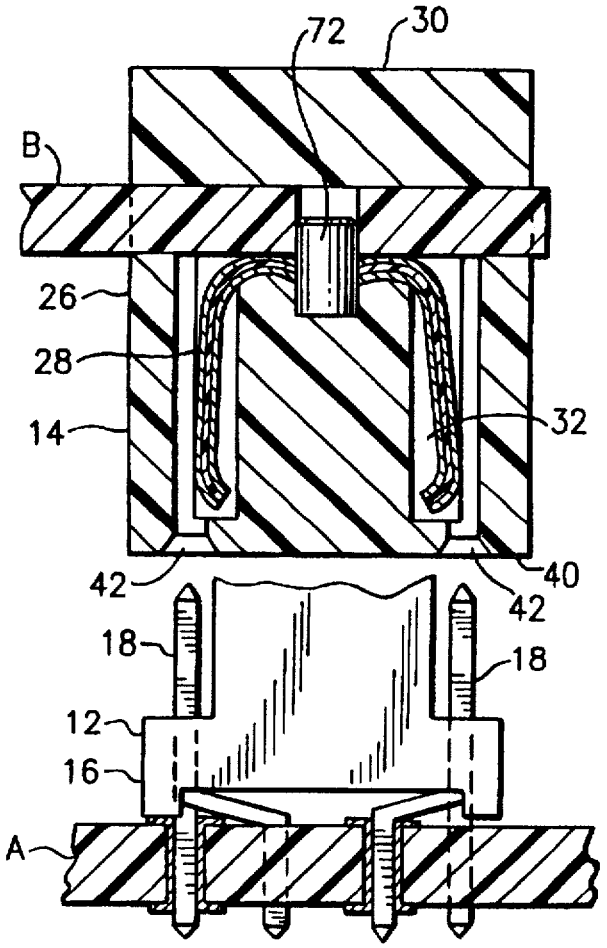
FIG. 3 is a cross-sectional view of the printed circuit boards and electrical connector assembly as shown in FIG. 1.

Referring also to FIGS. 2 and 3, the second connector 14 has a second housing 26, a contact strip 28, and a back support 30. The second housing 26 has a receiving area 32 therein. The top side 34 of the second housing 26 has an opening 36 and channels 38 therethrough. The bottom side 40 has pin receiving openings 42 into the receiving area 32. In alternate embodiments, other types of second housing configurations could be provided.

The contact strip 28 comprises a support 44 of resilient conductive material, an insulating layer 46 on the support 44, and signal conductors 48 on the insulating layer 46. The support 44 is preferably comprised of sheet metal that is cut and deformed into the shape shown. The support 44 has a center span 50, fingers 52 extending off of opposite sides of the center span 50, and structural supports 54 between the fingers 52. Virtually an entire side of the support 44 is covered by the insulative layer 46 except at areas 56*a* and 58*a*. The signal conductors 48 extend along some of the fingers 52; the fingers having the insulative layer 46 thereon. The insulating layer 46 keeps the conductors 48 electrically insulated from the support 44. The contact strip 28 forms two areas of contact; first portions 56 at the ends of the fingers 52 and second portions 58 near the center span 50. The contact strip 28 is located in receiving area 32 of the second housing 26. The printed circuit board B is located against the top surface 34. The back support 30 is connected to the second housing 26 to sandwich a portion of the board B therebetween. The second portions 58 and 58*a* contact pads on the board B. The first portions 56 and 56*a* are located in front of the pin receiving openings 42. In an alternate embodiment, the entire side of the support could be provided with the insulative layer and with conductors on all of the fingers. In this alternate embodiment specific ones of the conductors would be electrically connected to the support by suitable means.

The connector 10 allows the second printed circuit board B to be removably connected to the first printed circuit board A. When the second connector 14 is connected to the first connector 12, the pin contacts 18 make electrical contact with the signal conductors 48 at the first portions 56 and, with the support 44 at the ground contact portion 56*a*. The latches 20 slide up end slots 60 in the second housing 26 and are snap-lock latched therein. The support 44, in addition to its structural function, also functions as an electromagnetic shield to allow the conductors 48 to be placed close together. Thus, a high density of conductors 48 can be provided on the strip 28. The shielding by the support 44 reduces capacitance between conductors 48 and, thus, allows higher speed signals with reduced risk of cross-talk problems. The fingers 52 also allow individual reaction to wiping connection of the contact pins 18. The method of manufacturing the contact strip 28 is relatively simple. The connection or mounting of the contact strip 28 in the second housing 26 is also very simple. The holes 70 and alignment pegs 72 insure proper positioning of the contact strip 28 in the receiving area 32.

Figure 4:
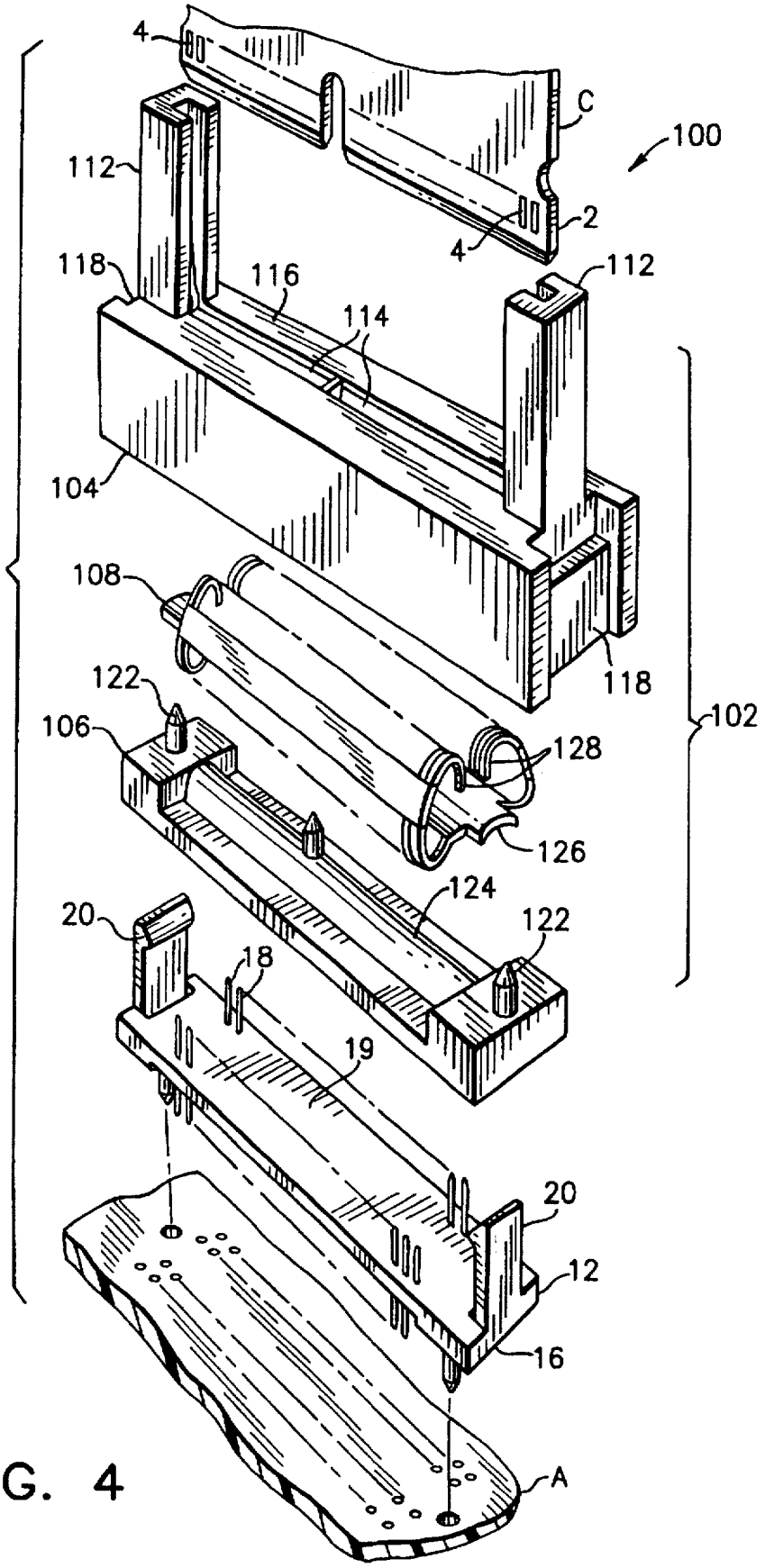
FIG. 4 is an exploded perspective view of portions of two printed circuit boards and an alternate embodiment of the electrical connector of the present invention.
Figure 5:
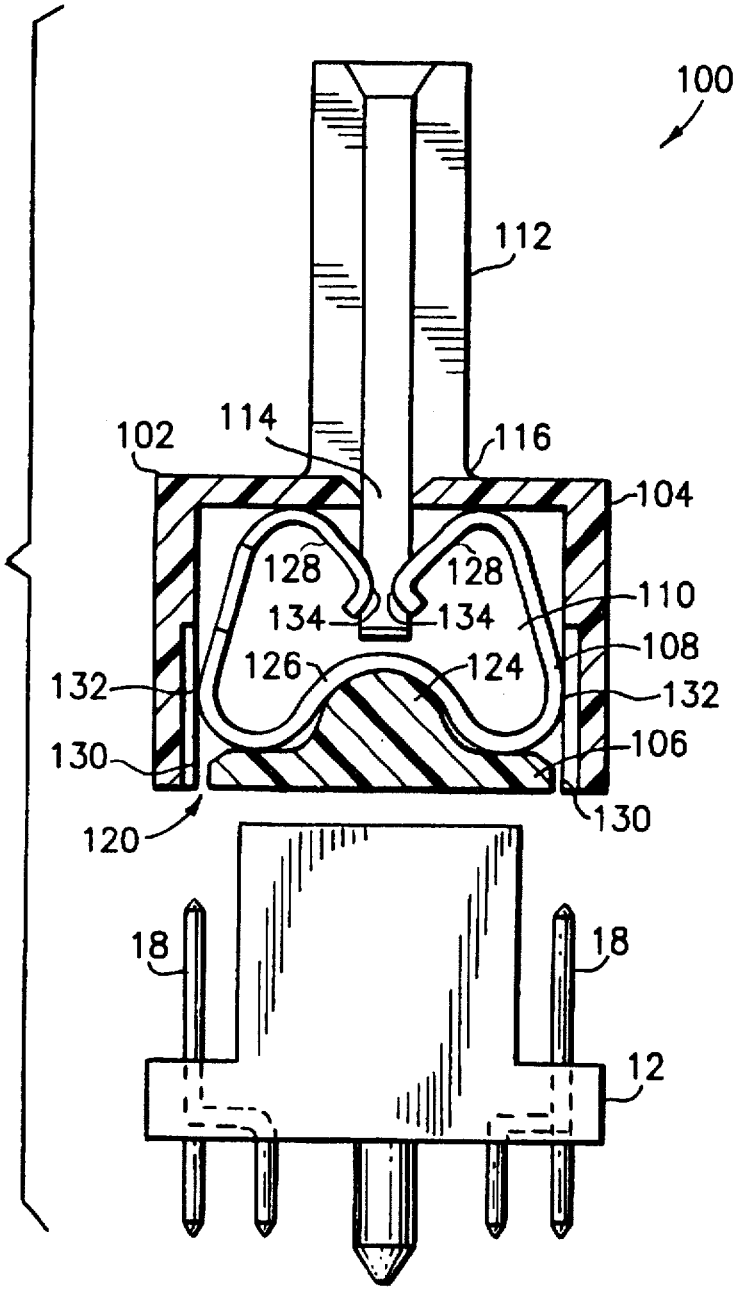
FIG. 5 is an exploded end view of the electrical connector assembly shown in FIG. 4 with a cross-sectional view of one of the connectors.

Referring now to FIGS. 4 and 5, an alternate embodiment of an electrical connector incorporating features of the present invention is shown. The electrical connector 100 includes the first connector 12 and a second connector 102. The second connector 102 comprises a first housing piece 104, a second housing piece 106, and a contact strip 108. The first housing piece 104 has a receiving area 110, upstanding guides 112, a card edge receiving slot 114 through its top side 116, end slots 118, and a bottom aperture 120 into the receiving area 110. The second housing piece 106 is suitably sized and shaped to be inserted into the bottom aperture 120 of the first piece 104. The second piece 106 has alignment pins 122 that are received in alignment holes (not shown) in the first piece 104. The second piece 106 also has a section 124 that functions as a yoke to press against the contact strip 108. The contact strip 108 is substantially similar to the contact strip 28 shown in FIG. 2. The contact strip 108 has a support made of flexible conductive material, a layer of insulation on the support, and a plurality of conductors on the insulation layer. Portions of the support do not have insulation. These portions establish ground contact areas. The contact strip 108 has its center span 126 on its bottom. The second housing piece 106 presses against the center span and the rest of the bottom of the contact strip 108. This presses the top of the contact strip 108 against the bottom side of the top of the first housing piece 104. This prestresses the fingers 128 in the card edge receiving area. With the two housing pieces 104, 106 connected to each other, bottom pin receiving apertures 130 are formed. There apertures 130 are adapted to receive the pin contacts 18 of the first connector therethrough. The width of the second housing piece 106 is suitably sized to fit between the two rows of pin contacts 18 and rest against the top surface 19 of the first connector housing 16. The end slots 118 receive the snap-lock latches 20 to lock the second connector 102 to the first connector 12 and, thus, to the first board A. When the first connector 102 is connected to the second connector 12, the contact pins 18 extend through the apertures 130 and into electrical contact with contact areas 132 on the contact strip 108. The contact strip 108 is able to slightly deflect to make a wiping contact with the contact pins 18. The daughter printed circuit board C has card edge connection area 2 with contact pads 4. The card edge connection area 2 is inserted through the slot 114 and into the receiving area 110. The contact areas 134 in the card edge receiving area make electrical contact with the contact pads 4. The fingers 128 slightly deflect during insertion of the daughter board C to make a wiping connection with the pads 4.

Figure 6:
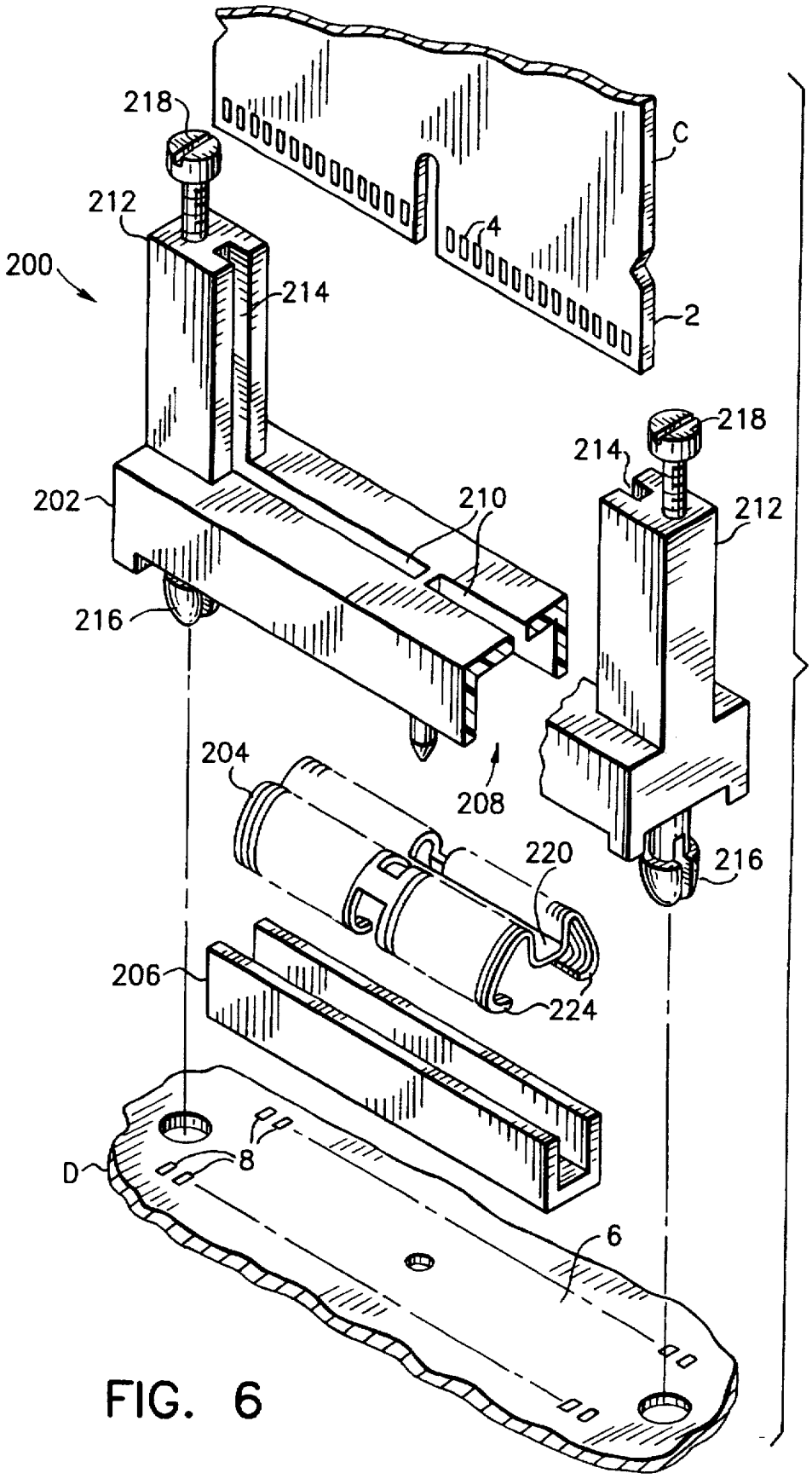
FIG. 6 is an exploded perspective view with a cut-away section of an alternate embodiment of the present invention.

Referring to FIG. 6, there is shown an alternate embodiment of the present invention. The connector 200 includes a housing 202, a contact strip 204, and a pressure yoke 206. The housing 202 includes a receiving area 208 with an open bottom and a top card edge receiving slot 210. The housing 202 has two upstanding card supports 212 with slots 214 for supporting ends of the daughter board C. The bottom of the housing 202 has spread fasteners 216 at both ends that are spread apart when fastener elements 218 are screwed in. The contact strip 204 is located in the receiving area 208. The depression 220 is for receiving the card edge connection area 2 of the daughter board C and making electrical connection with the contact pads 4. The pressure yoke 206 is located against the top surface 6 of the mother board D. The top surface 6 of the mother board D has surface contact areas 8 thereon. The yoke 206 fits between the two rows of surface contact areas 8. The pressure yoke 206 and housing 202 press the contact strip 204 into a suitable position to make appropriate contact with the pads 4 in the depression 220 and, pads 8. The pads 8 are surface contacted by ends 224 on the bottom of the contact strip 204. Thus, this embodiment shows that through-hole mounting of contacts is not always required.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector for connecting a first printed circuit board to a second printed circuit board, the connector comprising:

a housing having a first housing member connected to a second housing member, the first housing member having contact pins extending therethrough and the second housing member having a receiving area with first ends of the contact pins therein; and a contact strip having a support of resilient conductive material, an insulating layer on the support, and signal conductors on the insulating layer, the contact strip being located in the receiving area of the housing with the signal conductors contacting some of the first ends of the contact pins and also extending through openings in one side of the housing for connection to one of the printed circuit boards.

2. A connector as in claim 1 wherein the support of the contact strip has areas that are not covered by the insulating layer that form ground contact areas that contact some of the first ends of the contact pins and also extend through the openings in the housing.

* * * * *